United States Patent [19]

Moen

[11] Patent Number: 4,591,066

[45] Date of Patent: May 27, 1986

[54] PLASTIC CONTAINER WITH BASE CUP FORMED FROM SINGLE BLOW MOLDED PLASTIC BODY

[75] Inventor: Bruce A. Moen, Golden, Colo.

[73] Assignee: Adolph Coors Company, Golden, Colo.

[21] Appl. No.: 634,135

[22] Filed: Jul. 25, 1984

[51] Int. Cl.[4] ..... B65D 23/00

[52] U.S. Cl. ..... 220/69; 215/12 R

[58] Field of Search ..... 220/72, 69, 67; 215/1 BC, 1 C, 12 R

[56] References Cited

U.S. PATENT DOCUMENTS 3,341,059 9/1967 Schild et al. ..... 220/67
3,838,789 10/1974 Cvacho ..... 220/69
3,948,404 4/1976 Collins et al. ..... 220/69 X
4,398,648 8/1983 Cerny et al. ..... 220/67
4,482,067 11/1984 Saito et al. ..... 215/12 R

*Primary Examiner*—Steven M. Pollard
*Attorney, Agent, or Firm*—Klaas & Law

[57] ABSTRACT

A unitary blow molded plastic body is described which may be severed to provide a plurality of body sections including a first body section, which may be used to receive a liquid therein, and a second body section which may be attached about a bottom portion of the first section to provide a stabilizing and reinforcing base cup. The compound plastic body formed by the first and second section may be sealed as by an aluminum can end to provide a sealed container capable of containing a pressurized liquid beverage such as soda pop or beer.

28 Claims, 13 Drawing Figures

PLASTIC CONTAINER WITH BASE CUP FORMED FROM SINGLE BLOW MOLDED PLASTIC BODY

BACKGROUND OF THE INVENTION

The present invention relates generally to sealed containers for holding liquids under pressure, and more specifically to a compound plastic container formed from a single blow molded plastic body for holding pressurized beverages such as beer and soft drinks.

Containers constructed from thermoplastic material have become widely used in the beverage industry, competing with traditional metal and glass containers. Attractive features of plastic containers include resistance to rupture; transparency, allowing viewing of the bottled contents; light weight, reducing shipping costs, and relatively low manufacturing costs. However, the low manufacturing cost benefit of thermoplastic containers is only realized when the container walls are of a relatively thin construction. Plastic containers with thick walls are relatively expensive because the cost of plastic per pound is greater than the cost of glass.

Thin wall construction has been the source of a number of problems. Under pressure, the cylindrical sidewall of a plastic container tends to expand, especially at the mid portion of the sidewall. Thus, if extremely thin wall containers are used, a bulging area at a mid portion of the sidewall is produced. Even if such a container is capable of holding pressurized contents without rupture, a bulging configuration is aesthetically unacceptable from a marketing standpoint. The bottomwall of a cylindrical container also tends to expand outwardly and assumes a convex configuration which causes the container to be unstable when placed on a flat surface. One manner of resolving this problem with the bottom wall is to substantially increase its thickness or to provide a container having a deeply recessed concave bottomwall. Both of these solutions have, for the most part, not been implemented due to the expense of providing such bottomwall configurations. Another solution which has been widely used in the industry, is to provide the container with a separate support base which is mounted at the bottom of the container to enclose the rounded bottomwall and provide a separate bottom surface capable of supporting the container. Such containers, sometimes referred to as composite containers, contain relatively less plastic material than a container having a single thick bottomwall portion and are thus less expensive to produce. Compound plastic containers have thus gained a general acceptance in the industry.

The convex bottomwall portion of a container body provided with such a base cup may be relatively thin walled with respect to the cylindrical sidewall portion of the container body due to the fact that a convex or hemispherical wall configuration is inherently stronger than the cylindrical configuration of the sidewall and also due to the fact that additional strength may be provided to the bottom portion by the surrounding base cup. However, it is generally desirable to provide a relatively high-strength base cup since this portion of the container is most likely to be subjected to shocks.

In conventional blow forming techniques used to produce such a composite container, it is conventional to provide one mold for the blow molded body portion of the container and to provide a second mold to produce the base cup portion of the container. Each blow molded container and base cup, subsequent to blow molding, may be trimmed as necessary to remove any undesirable preform connection structure and are thereafter fixedly attached to one another by various attachment means.

Plastic containers and methods of forming and assembling plastic containers have been the subject of numerous patents.

Whitman U.S. Pat. No. 2,717,619 discloses a cylindrical container which may be made from blow molded polyethylene which has a generally cylindrical shape with a plurality of circumferential ribs at the outer surface thereof. The cup is provided with rib receiving recesses on the inner surface thereof may be slipped over the top of the container and sealed thereto with a wire band or the like. The container may be cut with the ribs to place the top thereof at the same level as the unused contents therein and the cup may thereafter be resealed over the newly formed top surface.

Thielfoldt U.S. Pat. No. 3,084,395 and Britten U.S. Pat. No. 3,187,381 disclose methods of blow molding hollow articles from plastic material.

Hunter U.S. Pat. No. 3,198,375 discloses a blow molded plastic container having a closure member formed integrally with the remainder of the container in the molding process and subsequently severed therefrom and introduced into a frictionally interlocking position to effect closure of the end opened by the severance after the container is filled with liquid.

Klygis U.S. Pat. No. 3,409,710 discloses a dual wall container formed from a hollow molded bottle by removing an upper portion of the neck of a container and applying it over the lower portion of the neck to seal the container.

Showalter et al. U.S. Pat. No. 3,632,717 discloses a container which may be made from a polyethylene composition which is centrifugally cast. After the casting step the molded product has no access opening, but has an outwardly projecting flange which is cut immediately adjacent a rib whereby the upper portion of the flange is removed to form an opening. The removed portion of the flange is again cut at another rib to form a dish shape cover which mates with the upper area of the previously cut rib at the mouth of the container. The device is closed by a channel shaped metal band which is expandable and contractable in diameter.

Doughty U.S. Pat. No. 3,726,429 discloses a composite package material for holding carbonated beverages which includes a thermoplastic container having a hemispherically shaped bottom section and a support for holding a container in an upright position which is formed from a thermoplastic compatible with the container. The support is heat sealed to the bottom section of the container.

Uhlig U.S. Pat. No. 3,949,034 discloses a container for retention of liquid under pressure formed from a blow molded plastic container having a bottom pressure wall which is formed during blowing by telescopically moving a bottom defining surface of the blow mold relative to the remainder of the blow mold.

Dodsworth et al. U.S. Pat. No. 3,978,232 discloses a thin walled container for pressurized liquids. An inner thin walled container is formed from high impact polystyrene. An outer restraining cup, made of high impact polystyrene and having a wall thickness which is greater than that of the inner container, engages at least an annular region of the container. The container has a gas impermeable liner such as BAREX 210, and acrylonitrile copolymer. The lid which seals the container may be aluminum of the pull ring type. The inner container is expanded by pressure of the sealed liquid whereby it engages the restraining cup which provides support and allows the container to be free standing so long as the carbonated beverage therein remains sealed. The cup is held to the inner container wall by frictional engagement and when the pressure in the inner container is released, the cup may be removed from a inner container and used as a drinking vessel.

Davis U.S. Pat. No. 4,127,430 disclosed a method of making a container having a blown plastic liner and method and apparatus for forming the same.

Jakobsen U.S. Pat. No. 4,293,359 discloses the use of a stabilizing foot supporting a plastic container at its lower end. Jakobsen teaches that various types of feet have been used in either parts projecting from the bottom of the bottle or separate parts fixed to the containers and that in the latter case these parts are applied to the container by snap engagement, riveting, or other methods. The type of plastic which can be used includes polyvinyl chloride (PVC) acetylonitrile (AN), and polyethylene terephthalate (PET).

Black U.S. Pat. No. 4,305,904 discloses a molding step in which the unwanted dome portion of the container is molded to have an engaging groove therein. The container is conveyed to a dome removal device which engages the groove in the dome, moves the dome against a cutting edge, and rotates the container to effectuate a complete removal of the dome. The method of removing a tail portion of the container is also disclosed. Both tail and dome removal operations are performed immediately after ejection of the containers from the molds while the plastic is still hot and pliable.

It is an object of the present invention to provide a composite thermoplastic container in a manner which eliminates one of the conventional blow forming steps used in producing such containers.

It is a further object of the invention to provide a thermoplastic container having a configuration capable of withstanding pressures associated with carbonated beverages such as beer and soft drinks.

It is another object of the invention to provide such a container configuration in an aesthetically pleasing shape.

It is another object of the invention to provide such a container using a minimal amount of thermoplastic material.

It is another object of the invention to provide such a container in a cylindrical can configuration.

It is another object of the invention to provide such a container with an inner lining structure.

It is another object of the invention to provide such a container without an inner liner structure.

It is another object of the invention to provide such a container in a transparent, translucent or opaque medium.

SUMMARY OF THE INVENTION

The present invention comprises a unitary blow molded plastic body for making a compound plastic body for use in a beverage container. The invention further comprises a beverage container made from the unitary blow molded plastic body and also a method of making such a container.

The invention includes a unitary blow molded plastic body comprising a preform connection section; an upper body section integrally formed with the preform connection section; a girth ring section integrally formed with the upper body section; a lower body section integrally formed with the girth ring section; the upper body section being severable from the girth ring section by a circular cut to form an end cup portion for a plastic container body; the lower body section being severable from said girth ring section by another circular cut to form a liquid receptacle portion for a plastic container body.

The invention also includes a beverage container for holding a liquid under pressure comprising a liquid receiving means for receiving liquid therein formed from a first portion of a unitary blow molded plastic body; cup means fixedly mounted on a bottom portion of the liquid receiving means in enclosing relationship with the bottom portion for providing a stable container base, the cup means being formed from a second portion of the unitary blow molded plastic body; and lid means for sealingly closing the liquid receiving means.

The invention also includes a method of making a compound plastic container comprising the steps of blow molding a plastic parison to form a plastic body having a preform section, an upper body section integrally formed with the preform section, a girth ring section integrally formed with the upper body section, and a lower body section integrally formed with the girth ring section; separating the upper body section from the girth ring section and separating the lower body section from the girth ring section by making circular cuts at associated interface portions thereof; and affixing the upper body section about a lower circumferential portion of the lower body section.

DETAILED DESCRIPTION OF THE INVENTION

Figure 1A:
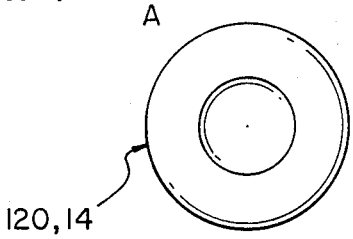
FIG. 1A is a bottom view of the container of FIG. 1.
Figure 1:
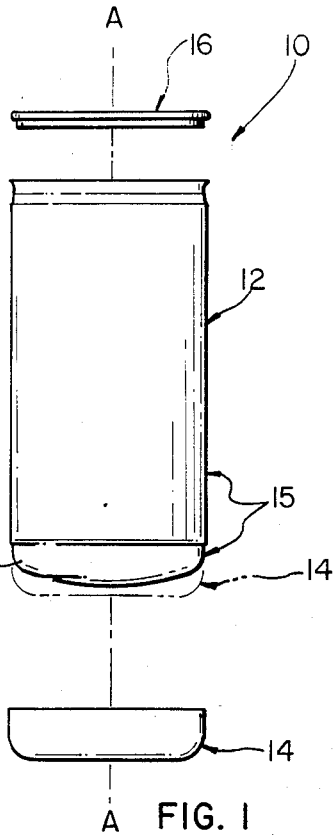
FIG. 1 is an exploded elevation view of a plastic container.
Figure 2:
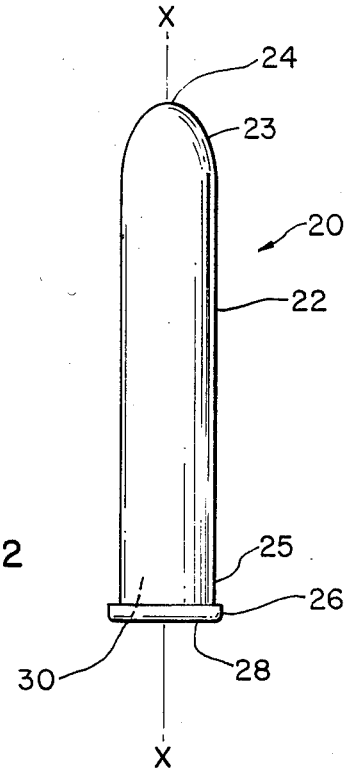
FIG. 2 is an elevation view of a parison.
Figure 8:
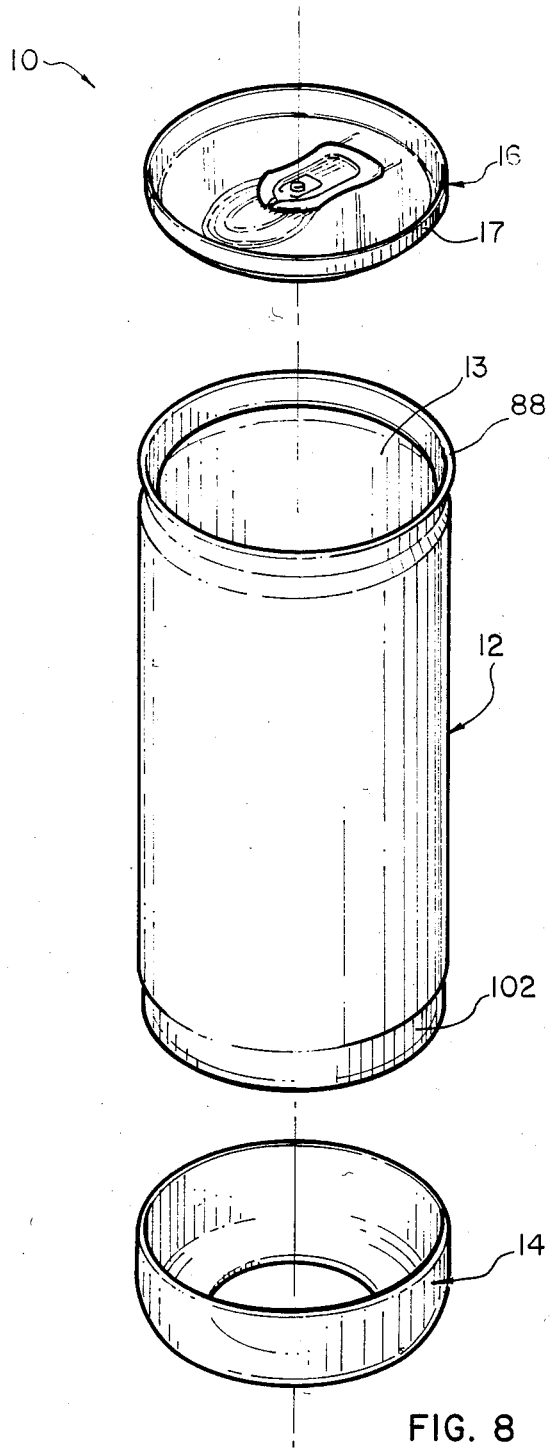
FIG. 8 is an exploded perspective view of the container of FIG. 1.
Figure 9:
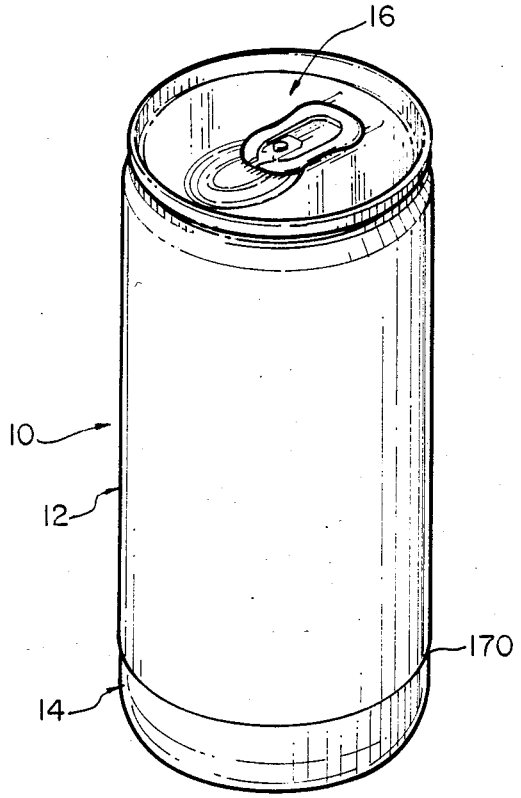
FIG. 9 is a perspective view of the container of FIGS. 1 and 8 in an assembled condition.

As shown by FIGS. 1, 8 and 9 in general, the present invention comprises a container means 10 including a plastic container body 12 having a lower dome portion 102 encompassed by a separate base cup means 14 operably fixed thereto by base cup attachment means, such as epoxy, sonic welding, mating surfaces, hot melt, glue, etc. The plastic container body 12 may comprise a circular opening 13 at the upper end thereof which may be sealingly closed by a separate upper can end 16 which may be of a conventional flanged can end construction such as used in conventional aluminum beer cans, soda cans and the like. The container body 12 and base cup unit 14 may both be formed from a single blow molded body means 40, illustrated in FIG. 3. The blow molded body means 40 may in turn be formed from a conventional tubular parison means 20, FIG. 2, constructed from a thermoplastic material such as polystyrene, which is formable by conventional blow molding techniques. The parison means 20 may comprise a longitudinal tubular member 22 having a central longitudinal axis XX running between a closed end portion 23 thereof and an open end portion 25 thereof. The closed end portion may comprise a rounded terminal end 24, and the open end portion 25 may comprise a circular opening 28 encompassed by an enlarged preform connector portion 26. The opening 28 allows entrance of blow forming gases into a central substantially cylindrical parison cavity 30 during blow molding of the parison. The parison may have a length of approximately 6–7 inches, an outer diameter of approximately 1–1½ inches and a wall thickness of substantially 0.076 inches and may have been formed as by molding with rotation or other standard injection molding techniques.

Figure 3:
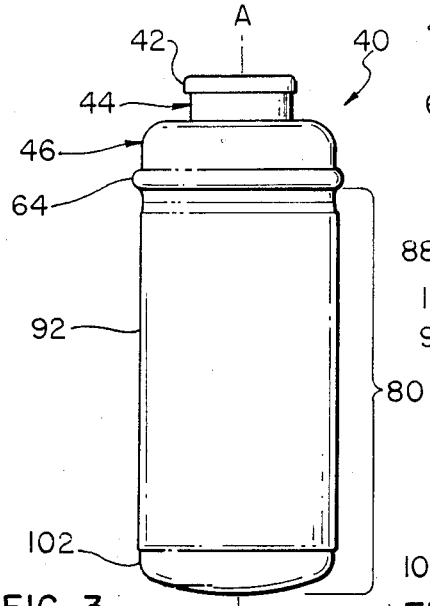
FIG. 3 is an elevation view of a blow molded body formed from a parison.
Figure 3A:
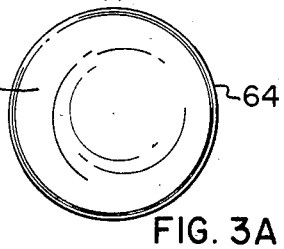
FIG. 3A is a bottom view of the blow molded body of FIG. 3.
Figure 5:
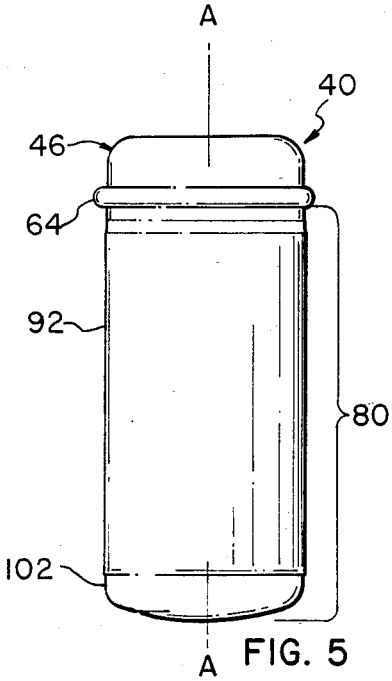
FIG. 5 is an elevation view of another embodiment of a blow molded body.
Figure 6:
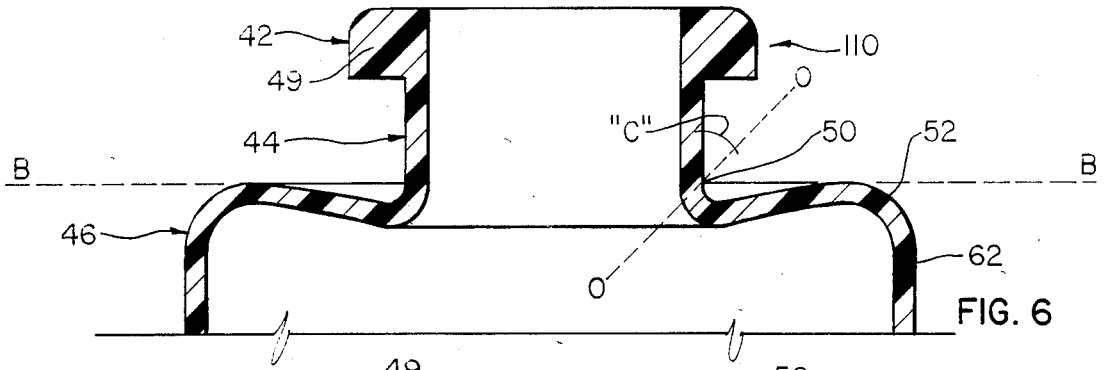
FIG. 6 is a detail cross-sectional view of an upper portion of the blow molded body of FIG. 3.
Figure 7:
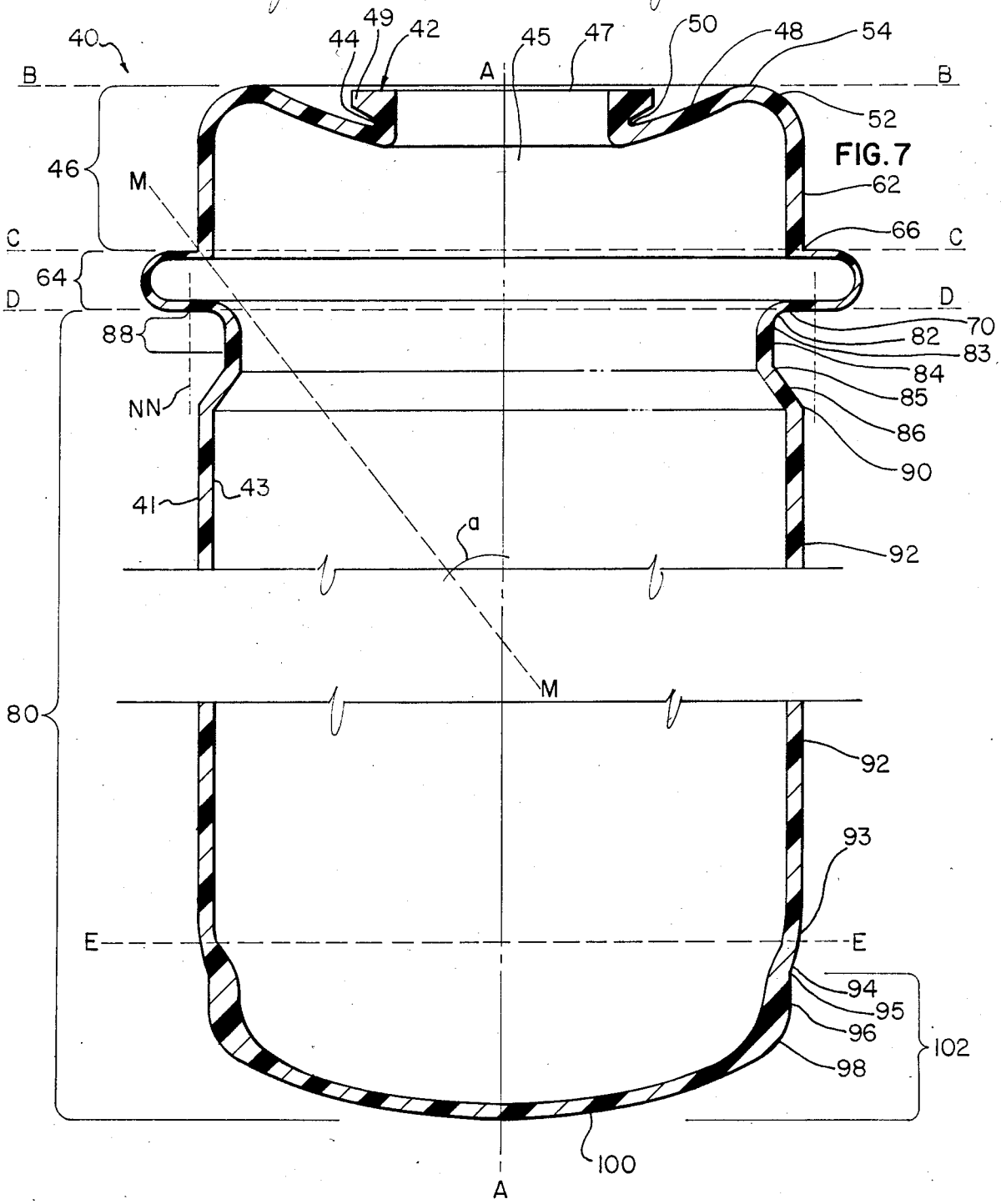
FIG. 7 is a detail cross-sectional view of the blow molded body of FIG. 5.

As shown by FIGS. 3, 3A, 5, 5A and 5B after blow molding, the body formed from the parison means 20 may comprise a blow molded body 40 having a central longitudinal axis AA coinciding with the original parison central longitudinal axis XX. The blow molded body means may comprise a preform connector section 42 having a configuration essentially unchanged from the configuration of the parison preform connector section 26. The blow molded body means may also comprise an elongate neck section 44 extending downwardly from the preform connector section and integrally joined to a body upper section 46 at a central portion thereof as shown by FIGS. 3 and 6. However, as shown by FIGS. 5 and 7, the length of the neck portion may be reduced so as to make it merely an interface portion allowing the preform section to be attached immediately adjacent a surface of upper body section 46. The upper body section 46 is in turn integrally connected to a girth ring section 64 having an external diameter greater than the upper body section 46. The girth ring section is integrally connected to a lower body section 80 comprising an upper wall portion 82, 84, 86; a relatively long length cylindrical wall portion 92; and a bottom dome portion 102.

Figure 4:
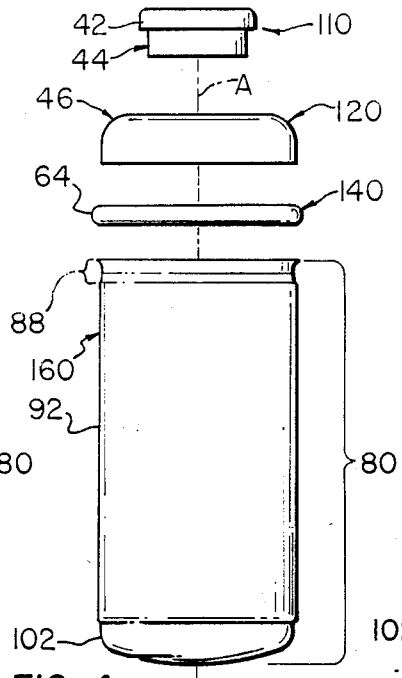
FIG. 4 is an exploded side elevation view of a severed blow molded body.

As illustrated in FIG. 4, subsequent to molding the blow molded body means 40 may undergo a number of cutting operations. A first circular cut may be made to separate a first cut-away portion 110, including preform connector section 42 and neck section 44, from the body upper section 46. A second circular cut may be made to separate a second cut-away portion 120, comprising upper body section 46, from girth ring portion 64. A third circular cut may be made to separate a third cut-away portion 140, comprising the girth ring section 64, from a fourth cut-away portion 160 comprising lower body section 80. The sequence of cutting operations may be in any order and may be varied depending on the particular cutting methods, e.g. water saw; fixed knife; rotating knife; laser; etc., used to process the blow formed container 40.

Subsequent to the cutting operations, a base cup means 14, comprising second cut-away portion 120, may be fixedly mounted on a container body means 12, comprising fourth cut-away portion 160, at its lower body bottom dome portion 102 to form a compound plastic body means 15. The inner diameter of the base cup means 14 and the outer diameter of the dome portion 102 are preferably such that the cup means 14 snugly engages the circumference of dome portion 94 along a substantial axial length thereof. The cup means 14 and container body means 12 are preferably constructed to provide a relatively smooth and continuous outer surface interface 170, FIG. 9.

Having thus described the invention in general, a more specific description of the preferred embodiments will now be provided. As shown by FIG. 7, the blow molded body means 40 comprises an outer surface 41 and an inner surface 43. The inner surface 43 defines a blow molded body cavity 45 having a cavity opening 47 at the upper end thereof defined by preform connector portion 42. In the preferred embodiment the cavity opening 47 and the preform connector section 42 are circular in shape. The preform connector section 42 may comprise an outwardly extending flange portion 49 for enabling attachment thereof to a conventional preform connector portion of a blow mold apparatus (not shown). The preform connection section is integrally connected to the blow molded body upper section 46 by a neck section 44 which may be an elongate neck section as illustrated in FIGS. 3 and 6. However, in the preferred embodiment illustrated in FIGS. 5 and 7, the neck portion 46 is merely an interface ring 50 between the preform connection section 42 and the upper body section 46. In one preferred embodiment the cavity opening 47 defined by the preform connection section 42 and neck section 44 may be 0.93–1.0 inches in diameter. The wall thickness of the neck section 44 may be 0.05–0.08 inches, and the radially measured maximum thickness of the flange portion 49 may be 0.10 inches.

The upper body section 46 may comprise an upper transversely extending concave wall portion 48 which, in a preferred embodiment, may have a wall thickness between 0.010 inches and 0.020 inches. The concave wall portion is integrally connected with the preform and/or neck section at a circular peripheral interface portion 50 thereof. The concave wall portion is integrally connected at the outer periphery thereof with an annular rounded shoulder portion 52. In a preferred embodiment, the rounded shoulder portion 52 has a radius of curvature of approximately ⅛–½ inches and comprises a wall thickness between 0.010 inches and 0.020 inches. The shoulder portion 52 comprises an axially uppermost peak contour ring 54 positioned substantially within a plane BB. In a preferred embodiment of the invention, the uppermost surface portion of the preform connector section 42 is positioned below plane BB. When the upper portion 46 is used as an end cup means 14, the shoulder peak contour ring 54 serves as a base surface. In this embodiment it is not necessary to trim the preform connector section 42 and/or neck section 44 from the upper body section 46, since the preform connector section 42 does not interfere with the surface 54 providing the stabilizing base surface.

The annular shoulder wall portion 52 is integrally connected with an upper body section cylindrical wall portion 62 which extends downwardly and is, in turn, integrally formed with girth ring portion 64. The axial length of the upper body section 46, as measured between plane BB and a plane CC coextensive with the bottom edge of wall surface 62, may be between 0.5 inches and 1.0 inches. The outer diameter of cylindrical wall portion 62 may be substantially 2.5 inches and the wall thickness of wall portion 62 may be between 0.010 inches and 0.020 inches. The outer surface of concave wall surface 48 may extend downwardly from plane BB a distance of approximately 0.06–0.3 inches.

Girth ring body section 64 may comprise a curvilinear inwardly opening cross section integrally connected with wall portion 62 at an interface ring 66 lying within plane CC. The outermost diameter of girth ring section 64 may be approximately 3 inches. The radius of curvature of the girth ring cross section may be approximately $\frac{1}{8}$–$\frac{1}{4}$ inches and the girth ring wall thickness may be between 0.005 inches and 0.020 inches.

The girth ring is integrally formed at a lower portion thereof with lower body section 80 at a girth ring interface ring 70 lying substantially within a plane DD positioned per-perpendicular axis AA. Ring 70 forms a double seamed can flange which may be seamed to a conventional aluminum end in a subsequent operation to complete the container. Lower body section 80 may comprise a first annular wall portion 82 having a relatively short axial length and a relatively small radius of curvature opening outwardly. In the preferred embodiment the first wall portion maximum outer diameter may be approximately 2.5 inches, the radius of curvature of its cross-section may be approximately 0.06–0.08 inches, and the wall thickness may be between 0.015 inches and 0.025 inches. Integrally formed with the first annular wall portion 82 at a circular interface portion 83 is a second relatively short axial length annular wall portion 84 having a generally cylindrical configuration. In the preferred embodiment, the second annular wall portion comprises an outer diameter of approximately 2.3 inches, an axial length of approximately 0.25 inches, and a wall thickness between 0.015 inches and 0.025 inches. Integrally formed with the second annular wall portion 84 at interface portion 85 is a third annular wall portion 86 having a downwardly and outwardly extending annular configuration. In the preferred embodiment the third annular wall portion comprises a maximum outer diameter of approximately 2.5 inches, a minimum outer diameter of approximately 2.3 inches, an axial length of approximately $\frac{1}{8}$–$\frac{1}{4}$ inches and a wall thickness of between 0.015 inches and 0.025 inches. In a preferred embodiment, the first and second annular wall portions 82, 84 form a lid mounting region 88 on the cutaway portion 160 formed from the blow molded body 40.

The third annular wall portion 86 is integrally connected at interface portion 90 to a fourth substantially cylindrical, relatively long length wall portion 92. In the preferred embodiment the fourth wall portion 92 comprises an outer diameter of approximately 2.5 inches, an axial length of approximately $4\frac{1}{8}$ inches, and a wall thickness between 0.015 inches and 0.025 inches. Integrally connected with the fourth wall portion 92 at 93 is a relatively small length downwardly and inwardly sloping annular transitional wall portion 94 which may have a thickness of between 0.015 inches and 0.025 inches. Integrally connected with the transition wall portion 94 at 95 is a sixth, generally cylindrical, relatively short length wall portion 96 having an outer diameter approximately equal to the inner diameter of girth ring 64 and a wall thickness of between 0.015 inches and 0.025 inches. Integrally connected with the sixth wall portion 96 is a seventh annular shoulder wall portion 98, having an inwardly opening radius of curvature of approximately $\frac{1}{4}$–$\frac{1}{2}$ inches and a wall thickness of between 0.015 inches and 0.030 inches. Integrally formed with the shoulder portion is an eighth convex bottom wall portion, comprising a wall thickness of between 0.010 inches and 0.020 inches, and having a radius of curvature of approximately 3 inches. The wall portions 94, 96, 98, and 100 may comprise a bottom dome portion 102 of lower body section 80, having an axial length measured from a plane EE containing interface ring 93 to the bottom of wall portion 100 of approximately $\frac{1}{2}$ inches.

In the preferred embodiment, the blow molded body means 40 is severed by a circular cut substantially at the intersection of the body means 40 and plane CC. The angle "a" of the cut (cone MM) at plane CC with respect to the central axis AA is preferably between 45° and 90°. The blown body is also severed at another circular cut, substantially at the intersection with plane DD at a cut cylinder NN substantially coaxial with axis AA. In an embodiment of the invention, such as illustrated in FIG. 6, wherein the preform connector section 42 and neck section 44 extend axially outwardly from the upper body section 46, a third cut is made, substantially at a plane BB parallel to the uppermost horizontal surface of the upper body section 46 at a cut (cone OO) angle "c" of between 20° and 60°. In the embodiment illustrated in FIGS. 6 and 3, the cuts provide a first cut-away portion 110, a second cut-away portion 120, a third cut-away portion 140, and a fourth cut-away portion 160, as illustrated in FIG. 4. When the embodiment illustrated in FIGS. 5 and 7 is used, the preform connection section 42 need not be removed, and thus only three cut-away portions 120, 140, and 160 are provided.

Only cut-away portion 120, which is used to form the base cup means 14 and cut-away portion 160, which is used to form the container body means 12, are used. The remainder of the cut-away portions may be discarded or reprocessed. As illustrated by FIGS. 1 and 9, the base cup means 14 is fixedly attached to the dome portion 102 of container body means 12. In a preferred embodiment, the diameter of the dome portion 102 and the wall thickness of the base cup means 14 are such that a relatively smooth and continuous outer surface is provided at the base cup means and container body means interface 170.

Figure 5B:
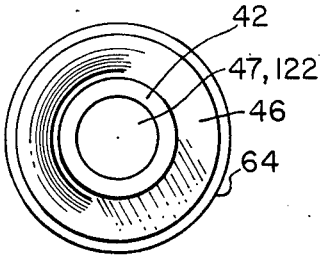
FIG. 5B is a top view of the blow molded body of FIG. 5.
Figure 5A:
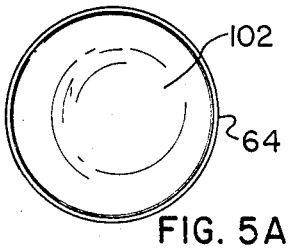
FIG. 5A is a bottom view of the blow molded body of FIG. 5.

It may be seen from FIGS. 1A, 5B and 8 that an end cup 14 comprises a central hole 122 in the transverse wall portion thereof. This central hole 122 may be defined by the interior circumference of the preform connector section 42 when the end cup is formed from a blown body means 40 of the type shown in FIGS. 5, 5B, and 7. The central hole may alternately be defined by the cut OO made in a blown body means of the type shown in FIGS. 3 and 6. The central hole 122 may facilitate the function of the base cup means 12 by allowing substantially greater flexing in the bottom transverse wall portion thereof than a continuous transverse wall would provide. The greater flexibility of the bottom transverse wall thus allows the end cup to be more resistant to rupture from shocks.

Upper can end means 16, in a preferred embodiment, comprises an outer rim portion 17 which may be crimped into sealing engagement with the lid mounting region 88 of the container body means 12 by standard aluminum end double seaming techniques, which are well known in the art.

In the preferred embodiment, the blow molded body means 40 and thus the compound container means 15 formed from the base cup means 14 and container body means 12 is constructed from polystyrene plastic, although a number of other thermal plastics, such as P.E.T. and polypropelene may also be used.

It has been found that a container means 10 having the wall thickness and dimensions as described above is capable of containing a liquid at a pressure of 60–150 psi with maximum diametric deformation in the cylindrical wall portion 92 of 2–4 percent. Such a deformation is considered aesthetically acceptable in the container industry. Since most soft drinks are packaged at pressures of 85 psi, at standard atmospheric conditions, the dimensions as described above provide an acceptable soft drink container. Beer, which is contained at a pressure of 30 psi, at standard atmospheric conditions, produces a maximum diametric deformation of cylindrical wall portion 92 of approximately 2–4 percent, and thus may also be packaged by the present container means 10 within accepted aesthetic standards.

It is contemplated that the inventive concepts herein described may be variously otherwise embodied and it is intended that the appended claims be construed to include alternative embodiments of the invention except insofar as limited by the prior art.

What is claimed is:

1. A beverage container for holding a liquid under pressure comprising:

liquid receiving means for receiving liquid therein formed from a first portion of a unitary blow molded plastic body;

cup means fixedly mounted on a bottom portion of said liquid receiving means in enclosing relationship with said bottom portion for providing a stable container base, said cup means being formed from a second portion of said unitary blow molded plastic body; and lid means for sealingly closing said liquid receiving means.

2. The invention of claim 1 wherein said liquid receiving means comprises a generally cylindrical container member having a central longitudinal axis and having a generally cylindrical interior cavity.

3. The invention of claim 2 wherein said generally cylindrical container member comprises:

an upper portion terminating in an annular lip defining a circular opening in said generally cylindrical interior cavity;

an elongate cylindrical middle portion; and a bottom portion.

4. The invention of claim 3, said annular lip of said upper portion terminating in a lip edge being formed by a circular cut severing said first portion of said unitary blow molded plastic body from another portion thereof.

5. The invention of claim 3, said upper portion including a lid attachment portion comprising:

a cylindrical wall; and said annular lip, said annular lip being integrally formed with an upper region of said upper portion cylindrical wall, said annular lip projecting substantially perpendicular said central longitudinal axis and having a relatively small radius, arcuate, outwardly opening cross-section.

6. The invention of claim 5, said generally cylindrical container member upper portion further comprising:

a downwardly and outwardly extending annular wall integrally formed with said upper portion cylindrical wall.

7. The invention of claims 5 or 6 wherein said lid means engagingly contacts said upper portion annular lip and said upper portion cylindrical wall.

8. The invention of claim 3 wherein said bottom portion comprises:

a transversely extending convex bottom wall;

a substantially cylindrical wall integrally connected with said convex bottom wall.

9. The invention of claim 8 wherein said cup means comprises:

a cylindrical wall terminating in a circular opening; and a transversely extending wall integrally connected with said cylindrical wall distal said circular opening.

10. The invention of claim 9 wherein the internal diameter of said cup means circular wall is substantially equal to the outer diameter of said elongate container member bottom portion cylindrical wall.

11. The invention of claim 10 wherein the axial length of said elongate container member bottom portion is substantially less than the axial length of said cup means whereby a spacing gap is provided between said elongate container member bottom portion transversely extending wall and said cup means transversely extending wall.

12. The invention of claim 11 wherein said cup means transversely extending wall comprises a planar surface portion thereon substantially perpendicular said central longitudinal axis for providing a flat base surface for allowing upright positioning of said beverage container as a horizontal base surface.

13. The invention of claim 12 wherein said cup means transversely extending wall comprises a central hole therein whereby said transverse wall is capable of substantial deformation in an axial direction prior to rupture.

14. A plastic can formed from a unitary blow molded plastic body and a metal lid comprising:

A. a liquid receiving means having an opening therein and formed from a lower body section of a unitary blow molded plastic body, the liquid receiving means comprising:

a. a first annular wall portion with a relatively small radius outwardly opening cross-sectional configuration;

b. a second generally cylindrical relatively short length annular wall portion integrally connected with said first annular wall portion;

c. a third downwardly and outwardly inclined annular wall portion integrally connected with said second annular wall portion;

d. a fourth substantially cylindrical relatively long length wall portion;

e. a fifth relatively short length annular transition wall portion;

f. a sixth generally cylindrical relatively short length wall portion;

g. a seventh annular shoulder wall portion;

h. an eighth outwardly convex transversely extending wall portion;

B. a cup means for providing a support base formed from said upper body section of said blow molded plastic body and fixedly attached to said liquid receiving means, said cup means comprising:

a. an upper transversely extending concave wall portion integrally connected with said preform connection section at a central area of said concave wall portion;

b. an annular shoulder portion extending around the circumference of said concave wall portion and integrally formed therewith;

c. a cylindrical wall portion integrally formed with said shoulder wall portion; and C. lid means for sealingly closing the opening in said liquid receiving means fixedly attached thereto.

15. The invention of claim 14, said liquid receiving means and said cup means being made from polystyrene:

said liquid receiving means first wall portion comprising an outer diameter of substantially 2.5 inches; a radius of curvature of between 0.06 inches and 0.08 inches, and a wall thickness between 0.015 inches and 0.025 inches;

said liquid receiving means second wall portion comprising an outer diameter of substantially 2.3 inches; an axial length of substantially ¼ inches and a wall thickness between 0.015 inches and 0.025 inches;

said liquid receiving means third wall portion comprising a maximum outer diameter of substantially 2.5 inches, a minimum outer wall diameter of substantially 2.3 inches, an axial length of between ⅛ inches and ¼ inches, and a wall thickness between 0.015 inches and 0.025 inches;

said liquid receiving means fourth wall portion comprising an outer diameter of substantially 2.5 inches, an axial length of substantially 4⅛ inches, and a wall thickness between 0.015 inches and 0.025 inches;

said liquid receiving means fifth wall portion comprising wall thickness of between 0.015 inches and 0.025 inches;

said liquid receiving means sixth wall portion comprising an outer diameter of substantially the same as base cup inside diameter and a wall thickness of between 0.015 inches and 0.025 inches;

said liquid receiving means seventh wall portion comprising a wall thickness of between 0.015 inches and 0.030 inches;

said liquid receiving means eighth wall portion comprising a wall thickness between 0.010 inches and 0.020 inches.

16. The invention of claim 14 or 15:

said cup means upper transversely extending concave wall surface comprising a wall thickness between 0.010 inches and 0.020 inches;

said cup means annular shoulder portion comprising a wall thickness of between 0.010 inches and 0.020 inches; and said cup means cylindrical wall portion comprising an outer diameter of substantially 2.5 inches, an axial length of between 0.5 inches and 1.0 inches, and a wall thickness of between 0.010 inches and 0.020 inches.

17. A plastic can formed from a unitary blow molded plastic body and a metal lid comprising:

A. a liquid receiving means having an opening therein and formed from a lower body section of a unitary blow molded plastic body having a generally cylindrical configuration symmetrically positioned about a molded body central longitudinal axis and defining a blow molded body opening:

a. a preform connection section symmetrically positioned about said central longitudinal axis;

b. an upper body section having:

i. an upper transversely extending inwardly concave wall portion integrally connected with said preform connection section at a central area of said concave wall portion;

ii. an annular shoulder portion extending around the circumference of said concave wall portion and integrally formed therewith;

iii. a cylindrical wall portion integrally formed with said shoulder wall portion;

c. a girth ring section having an outer diameter greater than the outer diameter of said upper body section cylindrical wall portion and having a wall with a relatively small radius outwardly convex cross-sectional configuration, said girth ring section being integrally formed with said cylindrical wall portion of said upper body section;

d. a lower body section having:

i. a first annular wall portion with a relatively small radius outwardly opening cross sectional configuration integrally connected with said girth ring section;

ii. a second generally cylindrical relatively short length annular wall portion integrally connected with said first annular wall portion;

iii. a third downwardly and outwardly inclined annular wall portion integrally connected with said second annular wall portion;

iv. a fourth substantially cylindrical relatively long length wall portion;

v. a fifth relatively short length transition wall portion;

vi. a sixth generally cylindrical relatively short length wall portion;

vii. a seventh annular shoulder wall portion; and viii. an eighth outwardly convex transversely extending wall portion;

B. a cup means for providing a support base formed from said upper body section of said blow molded plastic body and fixedly attached to said liquid receiving means; and C. lid means for sealingly closing the opening in said liquid receiving means fixedly attached thereto.

18. A unitary blow molded plastic body comprising:

a. a preform connection section;

b. an upper body section integrally formed with said preform connection section;

c. a girth ring section integrally formed with the upper body section;

d. a lower body section integrally formed with said girth ring section;

e. said upper body section being separable from said girth ring section by a circular cut to form an end cup portion for a plastic container body;

f. said lower body section being severable from said girth ring section by a circular cut to form a liquid receptacle portion for a plastic container body.

19. The invention of claim 18 wherein said lower body section is severable from said girth ring section to define a can end attachment lip thereon capable of receiving a can end thereabout in sealed relationship therewith.

20. The invention of claim 19 wherein said upper body section has a configuration adapted to encompass a bottom portion of said lower body section.

21. The invention of claim 20 wherein said upper body section comprises:

a transversely extending upper wall portion having a centrally positioned hole therein;

a shoulder wall portion integrally formed with said transversely extending upper wall portion at a circumferential portion thereof; and a cylindrical wall portion integrally formed with said shoulder wall portion.

22. The invention of claim 21 wherein said transversely extending upper wall portion is inwardly concave and wherein said shoulder portion comprises a substantially planar ring area thereon positioned uppermost on said upper body section.

23. The invention of claim 22 wherein said preform connection section is severable from said upper body section at a position on said transversely extending wall portion located below said uppermost positioned ring area of said shoulder wall portion whereby said uppermost ring area forms a stable base surface in an inverted position.

24. The invention of claim 22 wherein said preform connection portion comprises an uppermost surface positioned entirely below said upper body section shoulder portion ring area whereby said uppermost ring area forms a stable base surface in an inverted position.

25. The invention of claim 23 or 24 wherein said upper body section comprises an axial length substantially greater length than the axial length of said lower body section bottom portion whereby a bottom gap is provided between said transversely extending wall portion of said upper section and a transversely extendihg wall portion of said lower body section bottom portion when said upper body section is severed from said girth ring and mounted about said bottom portion.

26. A method of making a compound plastic container comprising the steps of:

a. blow molding a plastic body having a preform section, an upper body section integrally formed with the preform section, a girth ring section integrally formed with the upper body section, and a lower body section integrally formed with the girth ring section;

b. separating the upper body section from the girth ring section and separating the lower body section from the girth ring section by making circular cuts at associated interface portions thereof; and c. affixing the upper body section about a lower circumferential portion of the lower body section.

27. The method of claim 25 further comprising the step of filing a central cavity portion of the lower body section with a liquid.

28. The method of claim 26 or 27 further comprising the step of:

d. sealingly attaching a can lid about an upper peripheral portion of the lower body section so as to enclose a central cavity portion of the lower body section.

* * * * *